US008312916B2

(12) United States Patent
Storm et al.

(10) Patent No.: US 8,312,916 B2
(45) Date of Patent: Nov. 20, 2012

(54) METHOD FOR CASTING A COMPOSITE INGOT

(75) Inventors: Joost Christiaan Storm, Akersloot (NL); Andreas Ten Cate, Amsterdam (NL); Ingo Günther Kröpfl, Polch (DE); Achim Bürger, Höhr Grenzhausen (DE)

(73) Assignee: Aleris Aluminum Koblenz GmbH, Koblenz (DE)

( * ) Notice: Subject to any disclaimer, the term of this patent is extended or adjusted under 35 U.S.C. 154(b) by 8 days.

(21) Appl. No.: 13/000,296

(22) PCT Filed: Jun. 3, 2009

(86) PCT No.: PCT/EP2009/056811
§ 371 (c)(1),
(2), (4) Date: Mar. 7, 2011

(87) PCT Pub. No.: WO2010/000553
PCT Pub. Date: Jan. 7, 2010

(65) Prior Publication Data

US 2011/0146937 A1 Jun. 23, 2011

(30) Foreign Application Priority Data

Jul. 4, 2008 (EP) ..... 08012105

(51) Int. Cl.
*B22D 11/00* (2006.01)
*B22D 19/00* (2006.01)

(52) U.S. Cl. ..... 164/461; 164/419; 164/98

(58) Field of Classification Search ..... 164/461, 164/419, 91, 98, 107
See application file for complete search history.

(56) References Cited

U.S. PATENT DOCUMENTS

| | | | | |
|---|---|---|---|---|
| 2,800,709 | A | 7/1957 | Gaul | |
| 5,226,953 | A * | 7/1993 | Hodes et al. | 75/693 |
| 7,250,221 | B2 | 7/2007 | Ballyns et al. | |
| 2005/0011630 | A1 * | 1/2005 | Anderson et al. | 164/461 |
| 2005/0269056 | A1 * | 12/2005 | Mergen et al. | 164/461 |
| 2009/0169917 | A1 | 7/2009 | De Smet et al. | |
| 2009/0202860 | A1 | 8/2009 | Lahaije | |
| 2009/0280352 | A1 | 11/2009 | De Smet et al. | |

FOREIGN PATENT DOCUMENTS

| | | | |
|---|---|---|---|
| JP | 2002-263799 | A * | 9/2002 |
| WO | 2007/128389 | A1 | 11/2007 |
| WO | 2007/128390 | A1 | 11/2007 |
| WO | 2007/128391 | A1 | 11/2007 |
| WO | 2009/059826 | A1 | 5/2009 |

* cited by examiner

*Primary Examiner* — Kevin P Kerns
(74) *Attorney, Agent, or Firm* — Novak Druce + Quigg, LLP

(57) ABSTRACT

Method and apparatus employing a casting mould including a liquid feed end for supplying the casting mould with molten second alloy and an exit end with an outlet for casting molten second alloy downwardly. While continuously moving the mould and an elongated solid first alloy substrate relative to one another, casting molten second alloy passes downwardly through at least one outlet of the mould onto an upper surface of the substrate at a temperature wherein the substrate locally at least partly remelts beginning at a reference point of a remelting zone and mixes at least partly with molten second alloy to form an alloy pool. After remelting the molten alloy pool continuously cools and solidifies at a location away from the reference point and joins the substrate to form composite ingot including at least two separately formed layers of one or more alloys before discharging from the mould.

20 Claims, 3 Drawing Sheets

METHOD FOR CASTING A COMPOSITE INGOT

CROSS-REFERENCE TO RELATED APPLICATIONS

This application is a §371 National Stage Application of International Application No. PCT/EP2009/056811, filed on 3 Jun. 2009, claiming the priority of European Patent Application No. 08012105.6 filed on 4 Jul. 2008.

FIELD OF THE INVENTION

This invention relates to a method and apparatus for casting of composite metal ingots comprising at least two separately formed layers of one or more alloys.

BACKGROUND TO THE INVENTION

As will be appreciated herein below, except as otherwise indicated, aluminium alloy designations and temper designations refer to the Aluminum Association designations in Aluminum Standards and Data and the Registration Records, as published by the Aluminum Association in 2008.

For any description of alloy compositions or preferred alloy compositions, all references to percentages are by weight percent unless otherwise indicated.

For many years metal ingots, particularly aluminium ingots, have been produced by a semi-continuous casting process known as direct chill casting or electro-magnetic casting. In this procedure molten metal has been poured into the top of an open ended mould and a coolant has been applied directly to the solidifying surface of the metal as it emerges from the mould. Such a system is commonly used to produce large rectangular-section ingots for the production of rolled products, e.g. aluminium alloy sheet products. There is a large market for composite ingots consisting of two or more layers of different alloys. Such ingots are used to produce, after rolling, clad sheet for various applications such as brazing sheet, aircraft sheet, clad automotive sheet and other applications where it is desired that the properties of the surface be different from that of the core.

The conventional approach to such clad sheet has been to hot roll slabs of different alloys together to "pin" the two together for example by means of welding, then to continue rolling to produce the finished product, for example as disclosed in U.S. Pat. No. 2,800,709. This has a disadvantage in that the interface between the slabs is generally not metallurgical clean and bonding of the layers can be a problem.

Several alternative methods to improve on the bonding between the core ingot and the cladding are described in the literature.

Patent application US-2005/0011630-A1 describes what is also known in the art as the FUSION®-process (being a registered trademark of Novelis), and whereby two different alloys are cast in an open ended mould and by the use of special arranged dividers the first alloy pool contacts the second alloy pool at a point where the temperature of a self-supporting surface of the first alloy is between the solidus and liquidus temperature of the first alloy, and whereby the two alloy pools are joined as two layers and cooling the joined alloy layers to form a composite ingot.

In U.S. Pat. No. 7,250,221 a batch method is described of producing a clad metal ingot suitable for rolling to form a clad metal sheet, and wherein the upper rolling face of a solid core ingot is provided with multiple undercut cavities which are blocked when casting a cladding layer onto the upper rolling face. Once the cladding layer is solid, the cavities are unblocked and filled with a molten metal to form a metal lug therein attaching the cladding layer to the core ingot. This is reported to allow the cladding layer to contract without physical constraint during solidification and cooling, thereby avoiding the generation of internal tension and possible cracking. This approach overcomes at least partly layer separation during handling and rolling of the composite ingot.

SUMMARY OF THE INVENTION

It is an object of the invention to produce a composite metal ingot consisting of two or more layers.

It is a further object of the invention to produce a composite metal ingot consisting of two or more layers having an improved metallurgical bond between adjoining layers.

These and other objects and further advantages are met or exceeded by the present invention providing a method for the casting of a composite metal ingot comprising at least two separately formed layers of one or more alloys, the method comprises the steps:

(a) providing an elongated solid substrate of a first alloy and a molten melt of a second alloy, (b) providing a casting mould, the substrate and the casting mould being movable relative to one another, and wherein the casting mould comprises a liquid feed end for supplying the casting mould with a molten second alloy and an exit end with at least one outlet for casting the molten second alloy downwardly onto the substrate, and (c) while continuously moving the casting mould and the substrate relative to one another casting the molten second alloy downwardly through the at least one outlet of the casting mould onto an upper surface of the substrate at a temperature wherein the substrate locally at least partly remelts beginning at a reference point of a remelting zone and mixes at least partly with the molten second alloy to form an alloy pool, and after the remelting the molten alloy pool continuously cools and solidifies at a location away from the reference point and joins the substrate to form the composite ingot before discharging from the casting mould.

It is an important feature of the present invention that while continuously moving the casting mould and the substrate relative to one another the molten second alloy contacts the upper surface surface of the substrate of the first alloy, the molten second alloy has a temperature sufficiently high to assure local heating of the substrate such that the substrate on a local scale at least partly remelts and whereby the molten material or mushy metal from the substrate diffuses into or mixes with the molten second alloy.

Due to the remelting of the substrate in merely a thin surface layer, the aluminium oxide-layer, which is always present on an aluminium surface, is disrupted and possibly even fully disappears. This allows for an intense contact between the substrate and the molten second alloy forming a strong joint resulting in the composite ingot as the molten alloy continuously cools and solidifies while the casting mould continuously and the substrate move relatively to one another. As only a thin surface layer of the substrate is molten, typically less than about 2 mm in thickness and in the best examples about 40 to 60 micron in thickness, the amount of alloying elements absorbed into the second alloy is small and does not need to cause any significant metallurgical problems. And where appropriate the composition of the second alloy can be adjusted to receive the remolten substrate and to bring the final composition of the solidified clad layer onto the substrate at a predetermined target composition.

The unique structure of the interface between the substrate of the first alloy and the layer of the second alloy provides for a strong metallurgical bond, typically in the form of a substantially continuous metallurgical bond, at the interface and therefore makes the structure suitable for rolling to foil, sheet or plate without problems associated with delamination or interface contamination.

An advantage of the method according to this invention is that it does not require the multiple undercut cavities in the surface of the substrate formed by the first alloy as previously disclosed in U.S. Pat. No. 7,250,221 which is a very labour intensive and not cost effective for use on an industrial scale. Another advantage of the method of the invention is that it is carried out on a (semi-) continuous basis.

DETAILED DESCRIPTION OF PREFERRED EMBODIMENTS OF THE INVENTION

Figure 1:
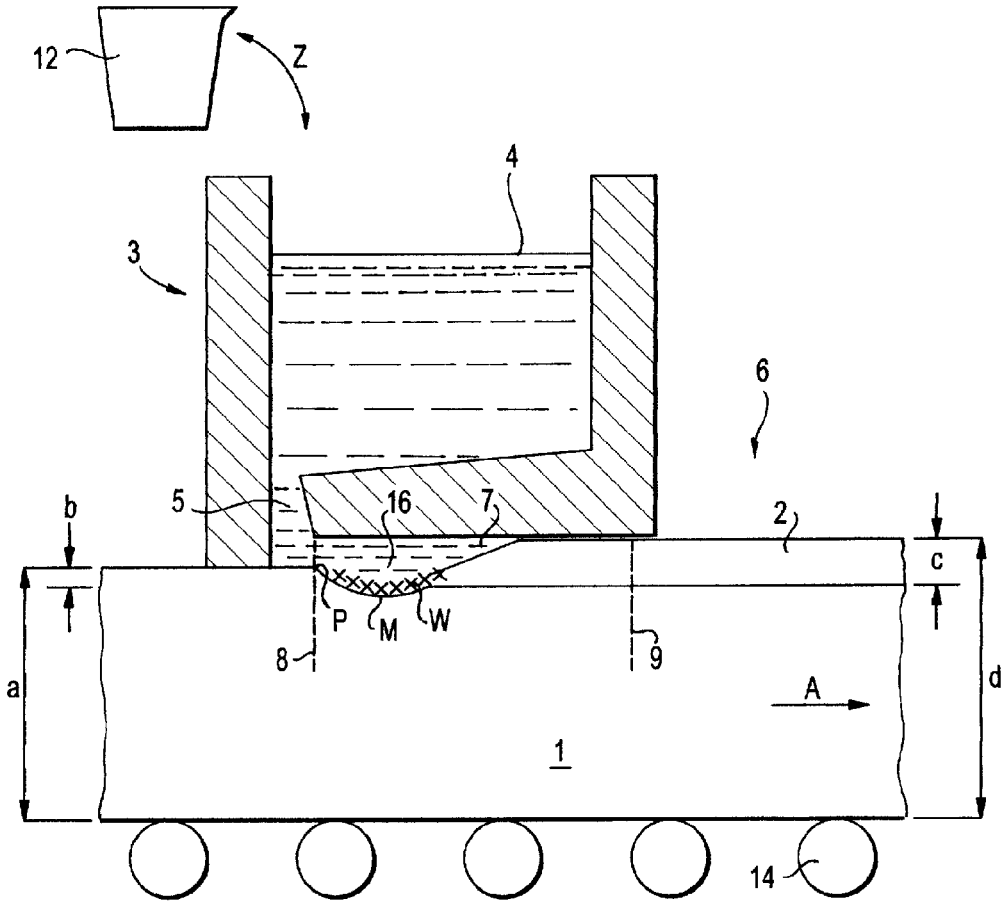
FIG. 1 is a schematic cross view of an embodiment of a casting mould of the present invention moving relative to the substrate to form a composite ingot.

The method according to this invention comprises the steps:

(a) providing an elongated solid substrate of a first alloy and a molten melt of a second alloy, (b) a casting mould, the substrate and the casting mould being movable relative to one another, and wherein the casting mould comprises a liquid feed end for supplying the casting mould with a molten second alloy and an exit end with at least one outlet for casting the molten second alloy downwardly onto the substrate, and (c) while continuously moving the casting mould and the substrate relative to one another, and preferably the substrate being movable relative to the casting mould, casting the molten second alloy downwardly through the at least one outlet of the casting mould onto an upper surface of the substrate at a temperature wherein the substrate locally at least partly remelts beginning at a reference point of a remelting zone and mixes at least partly with the molten second alloy to form an alloy pool, and after the remelting the molten alloy pool continuously cools and solidifies at a location away from the reference point and joins the substrate to form the composite ingot before discharging from the casting mould.

Preferably the substrate is not bent while contacting the second alloy, as this would introduce undesirable stresses into a thick gauge substrate as used in a preferred embodiment of this invention. In a preferred mode the substantially flat surface is kept substantially horizontal when casting the molten second alloy onto the substrate. Preferably the upper surface of the substrate is horizontal immediately upstream of the casting mould, immediately downstream of the casting mould, and as the substrate is fed through the mould.

And preferably the molten second alloy is fed from above the substrate onto an upper surface of the substrate while the substrate is horizontal, and more preferably the casting mould does not rotate.

In an embodiment of the method the substrate is preheated to a temperature in a range of 0.5 to 0.95, and preferably of 0.5 to 0.80, of its melting temperature in degrees Celcius (° C.), for example to a temperature of about 400° C. or of about 450° C. at the entrance to the casting mould for an aluminium alloy substrate. Suitable means of heating are selected from the group comprising a burner, an electron beam, electrical resistance, and a high frequency induction coil, or any other means to introduce locally heat. On an industrial scale of production a high frequency induction coil or an array of coils are preferred. By means of heating the substrate just prior to bonding of the second alloy layer it is achieved that the oxide-layer on the substrate is weakened which makes it easier to disturb the oxide-layer by the molten second alloy impinging on the substrate through the outlet of the casting mould. In this way the oxide-layer is easier disturbed and the temperature at which the molten second alloy leaves the exit end of the casting mould can be set at a lower temperature.

Ideally, the elongated solid substrate of the first alloy has a substantially flat surface onto which the second alloy is bonded via the method according to this invention. To form a double-sided clad substrate, a substrate clad in the described manner on one face may be inverted and the method of the invention repeated on the previously lower face of the substrate.

In another alternative it is possible to apply a further layer onto the upper surface of the composite ingot formed by the method of the invention, thus onto the upper surface of the second alloy layer. This further layer can be applied by various techniques known in the art, or as an alternative the casting method according to this invention can be used also to apply a further layer onto the composite ingot.

In a preferred mode the substantially flat surface is kept substantially horizontal when casting the molten second alloy onto the substrate. And preferably the substrate is not bent while contacting the second alloy.

In one embodiment, the substantially flat surface of the substrate is formed by the upper rolling face of a milled or scalped ingot, for example an ingot produced by means of e.g. DC-casting (direct chill casting) or EMC-casting (electromagnetic casting), which are techniques well known in the art and which provide a substrate having a thickness of at most about 500 mm, and typically a thickness in a range of about 200 to 450 mm. Ideally prior to applying the second alloy layer the substrate is scalped or milled to remove segregation zones near the cast surface originating from the casting of the ingot so that surface imperfections will not be worked into the finished product.

Depending on the alloy composition and the application of the final product made from the composite ingot, the substrate can be homogenised prior to bonding to a layer of the second alloy or alternatively it may have an as-cast non-homogenised microstructure. A homogenisation heat treatment of aluminium alloys has the following objectives: (i) to dissolve as much as possible coarse soluble phases formed during solidification of the ingot, and (ii) to reduce concentration gradients to facilitate the dissolution step. The soaking time at the homogenisation temperature according to industry practice is aluminium alloy dependent as is well known to the skilled person, and is commonly in the range of about 1 to 50 hours. Working with homogenised aluminium substrates is of particular interest for the invention when producing composite metal ingots wherein one of the two alloys has a melting point significantly lower than the other alloy.

In another embodiment, the substantially flat surface is formed by an upper rolling face of a rolled thick plate product, for example a plate product obtained by rolling cast feedstock obtained by DC casting to an intermediate gauge. The upper surface may be milled or otherwise cleaned so that surface imperfections will not be worked into the finished product.

In accordance with the invention the composite ingot preferably comprises of an aluminium alloy substrate having a thickness of at least about 40 mm, and preferably of at least about 70 mm. The clad layer thickness (feature (c) in FIG. 1) would have a preferred minimum thickness of 10 mm. For example when processing aluminium alloys, e.g. brazing sheet, a clad layer of about 15 mm is applied onto a substrate having a thickness of about 200 mm or a clad layer of about 35 mm is applied onto a substrate having a thickness of about 300 mm.

Preferably, the layer of the second alloy has a thickness in a range of about 2% to 30% of the thickness of the substrate, and preferably in a range of about 4% to 20%.

In a further embodiment of the invention the composite metal ingot is further worked by means of rolling, hot and cold rolling, to a rolled product at final gauge having a thickness in the range of up to about 5 mm.

The first and the second alloy may have substantially similar composition. Preferably the two metal alloys are aluminium alloy composed of different aluminium alloy compositions.

When processing aluminium alloys using the method according to this invention a typical casting speed is in a range of about 50 to 200 mm/min.

In one particularly preferred embodiment, the substrate of the first alloy is an aluminium alloy, typically an aluminium-manganese alloy, and the second alloy is an aluminium-silicon alloy. Such composite ingots, when hot and cold rolled, form a composite metal brazing sheet that may be subject to a brazing operation. In this embodiment the final gauge of the rolled product would be typically in the range of about 0.05 to 4 mm. The brazing sheet material is preferably up to about 350 microns thick at final gauge, and more preferably about 100 to about 250 microns thick.

In another particularly preferred embodiment, the composite ingot manufactured according to this invention is rolled into a clad aircraft sheet product.

In yet another particularly preferred embodiment, the substrate of the first alloy is aluminium of the 6000-series alloys and the second alloy is another alloy of the 6000-series alloy. Such composite ingots, when hot and cold rolled, form a composite sheet or a clad sheet product forming automotive body sheet, an automotive body panel, preferably an exterior body panel or a crash box configuration. The final thickness of the composite sheet would typically be in the range of about 0.5 to 2 mm. An example would be a clad sheet product having an AA6056 or AA6156 core alloy clad on one or both sides with an AA6016 cladding, or an AA6016 core alloy clad on one or both sides clad with an AA6005A alloy. Further examples of such clad sheet products are disclosed in international applications WO-2007/128391, WO-2007/128389, WO-2007/128390 and WO-2009/059826, all four patent documents incorporated herein by reference.

To improve the wetting behaviour of the molten alloys it is possible to add to the first alloy and/or the second alloy a wetting agent to lower the surface tension when being molten. In case the first and second alloys are aluminium alloys, it is preferred that one or more elements are selected from the group comprising Bi, Pb, Li, Sb, Se, Y, and Th, and wherein the total amount of the wetting elements in an aluminium alloy is in a range of about 0.005% to 1%, and preferably in a range of about 0.01% to 0.5%. For example about 0.1% of a wetting element like Bi can be added to the AlSi10 brazing layer when producing brazing sheet products using the method according to this invention.

In a further aspect of the invention it relates to an apparatus or casting device for carrying out the method according to the invention, comprising a casting mould and means for moving the substrate of the first alloy relative to the casting mould, and means for replenishing the feed end of the casting mould with molten feedstock of the second alloy; and wherein the casting mould comprising:

(i) a liquid feed end for supplying the casting mould with the molten second alloy, and (ii) an exit end with at least one outlet for casting the molten second alloy downwardly onto the substrate, and then into a casting channel of a casting chamber defined by the casting mould over the substrate, while continuously moving the substrate relative to the casting mould, the exit end being for casting the second molten alloy onto the substrate at a temperature at which the substrate locally at least partly remelts beginning at a reference point of a remelting zone and mixes at least partly with the molten second alloy to form an alloy pool or mushy pool, and wherein said means for moving comprising means for moving the molten alloy pool as the pool continuously cools and solidifies after the remelting, at a location away from the reference point and joins the substrate to form the composite ingot before discharging from the casting mould.

Furthermore, means for heating the substrate just prior to casting the second alloy onto the substrate can be provided.

The casting mould comprises a liquid feed end for supplying it with a molten metal and an exit end having at least one outlet for casting the molten metal onto a substrate.

The casting mould is preferably arranged such that at least a portion of the upper surface of the casting mould is planar. And more preferably the casting mould has a stationary upper surface. And preferably the casting mould does not rotate.

In an embodiment of the casting device the exit end of the casting mould is oriented for feeding the molten second alloy from above the substrate onto an upper surface of the substrate while the substrate is horizontal.

In an embodiment of the invention the casting mould in part or in whole is made of a refractory ceramic, metal, graphite, or metal coated with a refractory substance. The casting mould should be made from a heat resistant material, and preferably the part in contact with any molten metal does not wet the molten metal, and furthermore does not stick.

In an embodiment the casting mould is provided with sealing surfaces surrounding the mould at the upstream and lateral sides which seal against the substrate of the first alloy to prevent leakage therebetween.

In an embodiment of the casting device the means for moving the substrate has a horizontal surface for supporting a lower surface of the substrate horizontally immediately upstream of the casting mould, immediately downstream of the casting mould, and as the substrate is fed through the mould.

It can be desirable when manufacturing composite ingots according to the method of the invention, to use a metal flux material. For example, the solid substrate may be coated with a solid flux prior to casting of the molten second alloy onto the substrate, e.g. an aluminium potassium fluoride as commonly used in brazing operations, that cleans the respective surface of oxides, or at least disrupts the oxide layer, and ensures improved contact and transference of the metal at the contacting surfaces. To this effect a flux station can be included to treat the substrate surface before the casting mould.

In an embodiment of the casting the casting mould comprises a reservoir (see for example feature 4 in FIGS. 1, 2A and 2B) for the second molten metal alloy and a casting chamber;

the liquid feed end being the liquid feed end of the reservoir, the exit end with at least one outlet being the exit end of the reservoir, and the casting chamber to receive molten metal of the second alloy from the outlet, said casting chamber being formed by a casting channel extending from an upstream entry portion and the downstream exit portion for facing the substantially horizontally positioned movable substrate for containing and shaping the molten metal into a layer joined with the moving substrate to form a composite ingot; and the reservoir extending laterally in a downstream direction relative to the exit end;

the upper wall of the chamber extending laterally in a downstream direction relative to the exit end further than the reservoir.

In an embodiment of the casting device the casting mould comprises the liquid feed end, the exit end with at least one outlet, and a casting chamber to receive molten metal of the second alloy from the outlet, said casting chamber being formed by a casting channel extending from an upstream entry portion and the downstream exit portion for facing the substantially horizontally positioned movable substrate for containing and shaping the molten metal into a layer joined with the moving substrate to form a composite ingot.

In an embodiment of the casting device the casting device comprising a casting mould and means for moving a substrate of a first metal alloy relative to the casting mould, and means for replenishing the feed end of the casting mould with molten feedstock of a second metal alloy, the casting mould comprising:

a reservoir (see for example feature 4 in FIGS. 1, 2A and 2B) for the second molten metal alloy and a casting chamber;

the reservoir having an upstream generally vertical wall, an downstream generally vertical wall opposed to the upstream generally vertical wall, and a generally horizontal wall extending upstream from a lower end of the downstream vertical wall;

a lower surface of the generally horizontal wall and a lower end of the downstream generally vertical wall both spaced a distance above a horizontal phantom plane upon which a lower end wall of the upstream generally vertical wall lies defining an upper surface of a casting channel of the casting chamber, at least one reservoir outlet at an upstream end of the generally horizontal wall for feeding molten metal of the second alloy from the reservoir downwardly onto a horizontal substrate and then into the casting chamber, the casting channel extending horizontally under the generally horizontal wall from an upstream entry portion to a downstream exit portion for a distance longer than the thickness of the downstream vertical wall;

the casting channel positioned for facing the substrate, when the substrate is substantially horizontally positioned and movable relative to the casting mould, and containing and shaping the second molten metal into a clad layer against the moving substrate to form the composite ingot;

the casting channel having an open horizontal bottom for being blocked by the upper surface of the substrate for containing the molten second alloy between the lower surface of the generally horizontal wall and the upper surface of the generally horizontal substrate.

And wherein in a preferred embodiment the at least one reservoir outlet, for feeding molten metal of the second alloy from the reservoir downwardly into the casting chamber to receive from the outlet, is defined by a gap between an inner surface of the upstream generally vertical wall and an upstream end of the generally horizontal wall.

An in another preferred embodiment of the casting device the upstream entry position and the downstream exit portion each have a height above a phantom plane within which the upper surface of the movable substrate lies, and the height of the upstream exit portion is at least twice the height of the upstream entry portion.

Figure 3A:
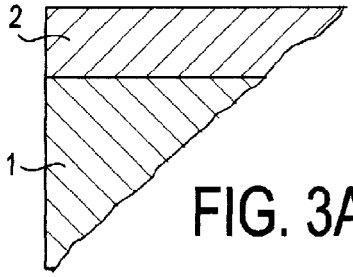
FIGS. 3A, 3B and 3C are schematic views of cross-sections of respective composite ingots.
Figure 3B:
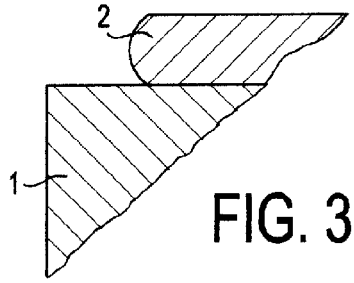
Figure 3C:
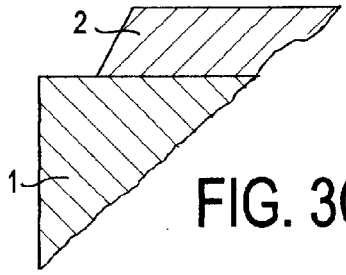
Figure 2A:
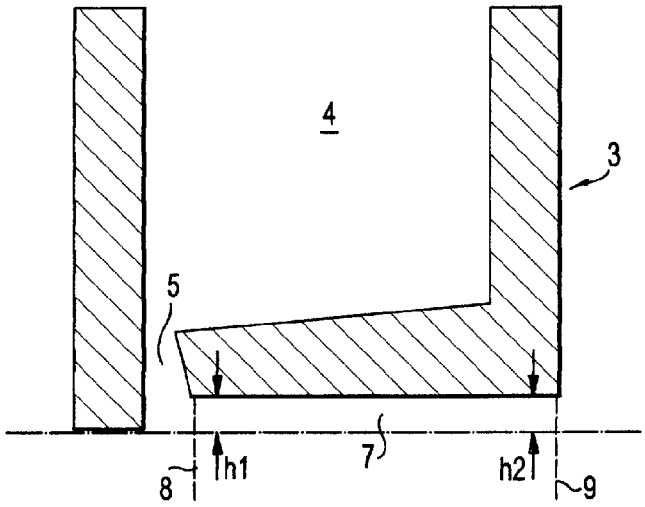
FIGS. 2A and 2B are schematic cross views of embodiments of the casting mould.
Figure 2B:
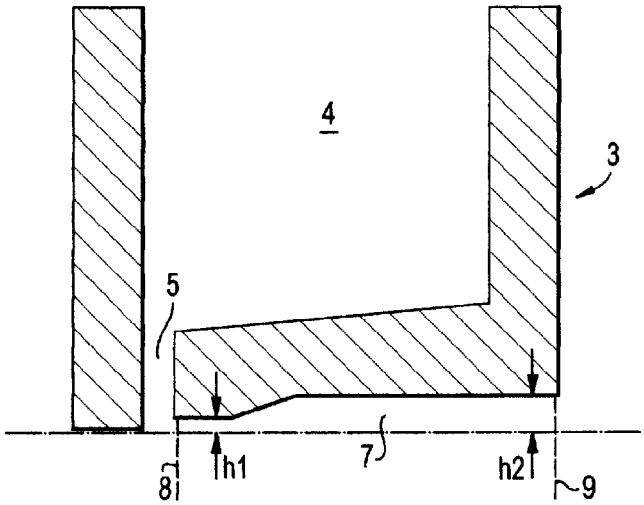
Figure 4:
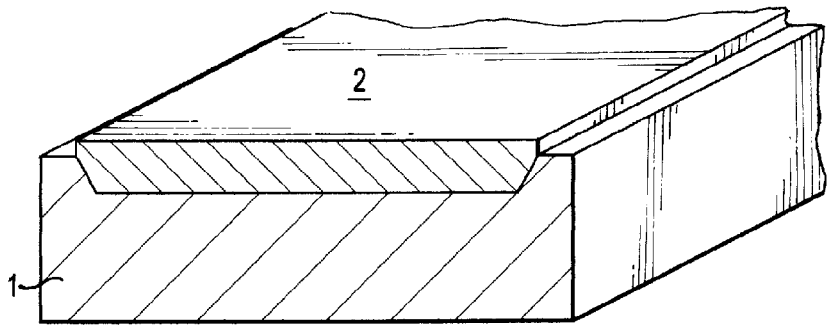
FIG. 4 is a schematic perspective view of a cross-section of a composite ingot.
Figure 5:
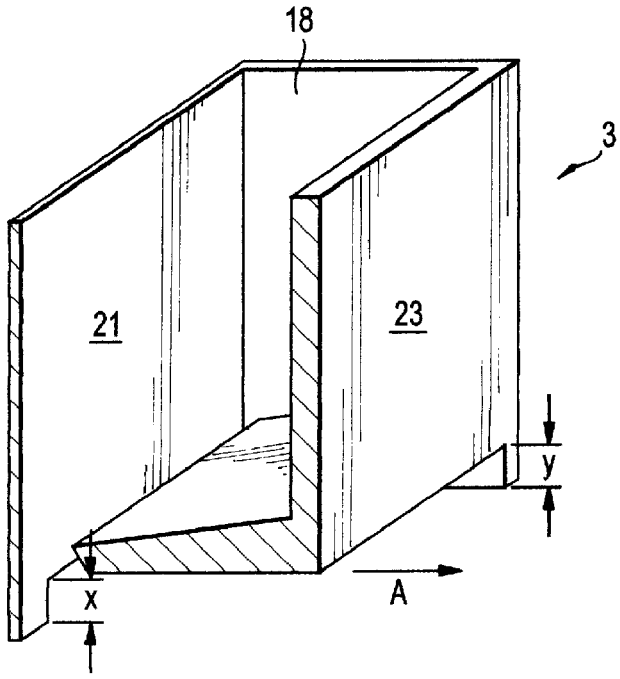
FIG. 5 is a schematic partial cross-sectional view of a first embodiment of the mould of FIG. 1.
Figure 6:
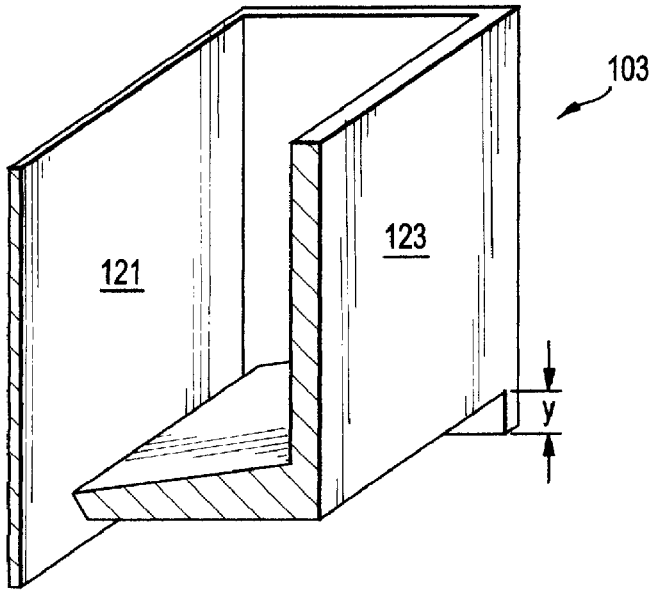
FIG. 6 is a schematic partial cross-sectional view of a second embodiment of a mould for use in the present invention.

Some preferred embodiments of the invention shall now be described with reference to the appended drawings, in which:

FIG. 1 is a schematic cross view of an embodiment of the casting mould moving relative to the substrate to form a composite ingot;

FIGS. 2A and 2B are schematic cross views of embodiments of the casting mould;

FIGS. 3A, 3B and 3C are schematic views of cross-sections of respective composite ingots;

FIG. 4 is a schematic perspective view of a cross-section of a composite ingot;

FIG. 5 is a schematic partial cross-sectional view of a first embodiment of the mould of FIG. 1; and FIG. 6 is a schematic partial cross-sectional view of a second embodiment of a mould for use in the present invention.

The casting mould (3) may be fed with molten alloy from a ladle (12). Typically the ladle (12) pivots in a direction indicated by a curved arrowed line "Z" in FIG. 1. In an alternative the casting mould (3) may be fed with molten alloy via a launder system feeding molten metal from a casting furnace to the casting mould. Typically the substrate (1) is conveyed under the casting mould 3 by any suitable conveying means. A typical conveying means is a roller table (14) shown in FIG. 1. Other suitable conveyors may also be employed.

The casting mould (3) according to the invention as shown in FIG. 1 comprises a liquid feed end or reservoir (4), an exit end with at least one outlet (5), a casting chamber to receive molten metal of a second alloy from the outlet, the casting chamber having a casting channel (7) extending from an upstream entry portion (8) to the downstream exit portion (9) for facing the substantially horizontally positioned movable (relative to the casting mould) substrate (1) for containing and shaping the molten metal into a clad layer (2) against the moving substrate to form a composite ingot (6). An upper wall of the casting chamber is defined by a lower wall of the mould (3). In use, a lower opening of the casting chamber is blocked by the substrate (1) or composite ingot (6). In use the molten metal of the second alloy is allowed to enter into the casting chamber through the upstream entry portion, thereby allowing the molten metal to fill the casting channel (7), the casting channel (7) at the downstream portion allowing the molten metal to cool while passing therethrough to solidify sufficiently to retain the shape of the casting channel when exiting the downstream exit portion.

FIG. 5 schematically shows a partial cross-section perspective view of an embodiment of the casting mould (3). Sidewalls (18) (one shown) of the mould (3) extend parallel to direction of ingot movement "A" to contain the molten alloy of molten alloy pool (16) during cooling. An upstream wall (21) has a lower opening of a height "X" and a downstream wall (23) of the mould (3) has a lower opening of height "Y". Height "X" is greater than height "Y". Height "X" accommodates entry into the mould (3) of at least an upper portion of the substrate (1). Height "Y" accommodates discharge of the composite ingot (6) and assists in containing the alloy pool.

FIG. 6 shows another embodiment of a mould (103) having a downstream wall (123) having a lower opening of height "Y" and an upstream wall 121 which does not have the raised lower opening of height "X". In this other embodiment the lower end of the upstream wall is entirely flush with the substrate (1) and rather than depositing a layer of second alloy (4) the width of the substrate (1) the mould deposits a curtain of alloy (4) narrower than the transverse width of substrate (1).

Other mould designs may also be employed.

The heat to cool and solidify is extracted mainly through the substrate (1) acting as a heat sink.

It is possible to introduce further cooling means, for example by using air, forced air, water cooling or mist cooling, in the casting mould and preferably near the downstream exit portion to remove heat from the solidifying or solidified clad layer formed by the second alloy of the composite ingot. In addition thereto it is possible to install further cooling means to cool the composite ingot once it has left the casting mould, for example by using air, forced air, water cooling or mist cooling.

In FIG. 1 the horizontal substrate (1) of a first alloy has a thickness (a) of which in use a thin surface layer having a thickness of about (b) which is remolten and forms part of the clad layer (2) having a thickness (c) to form a composite ingot having thickness (d). The thicknesses are such that (d)=((a)−(b))+(c).

In the embodiment of FIG. 1 the casting channel has substantially constant cross-sectional diameter, or constant height between the upper side of the casting channel and the lower side formed by the moving substrate into direction A. The molten metal enters the casting channel through the upstream entry portion (8).

When processing aluminium alloys typically the casting speed or the speed of movement into direction A is in a range of about 50 to 200 mm/min. While continuously moving the casting mould (3) and the substrate (1) relative to one another, the molten second alloy is cast through the one or more outlets (5) of the casting mould (3) onto the substrate (1) at a temperature whereby the substrate locally at least partly remelts at a reference point "P" of a remelting zone and mixes at least partly with the molten second alloy to form an alloy pool (16), the remelting of the first alloy continues to a point "M" (typically at about the maximum depth "b" of the molten alloy pool or mushy alloy pool). The remelting zone extends from point "P" to point "M". Reference point "P" is the point at which alloy of substrate (1) starts to at least partly melt. Reference point "P" may be at the entry (8) to the casting chamber; slightly upstream of the entry (8) to the casting chamber to be between mould upstream wall (21) and the entry (8) to the casting chamber; or slightly downstream of the entry (8) to the casting chamber. Maximum depth point "M" is within the casting chamber. Residence time and cooling of the molten alloy pool (16) in the casting chamber are sufficient to complete solidification of the composite ingot (6) before the composite ingot (6) discharges from the casting chamber exit (9). After remelting of the portion of the substrate (1) then the molten alloy pool (16) continuously cools and solidifies at a location away from the melting zone, hence away from the reference point "P", and joins the substrate to form the composite ingot (6).

Alloy mixing at least occurs in zone "W" (marked by x's) at the lower portion of the alloy pool 16.

In order to achieve some local melting in a thin surface layer of the substrate (1) of the first alloy, the temperature of the second alloy when entering the upstream entry portion should be sufficiently high. By melting of a thin surface layer of the substrate (1) the oxide layer inevitably present at the surface of the substrate is disrupted and allows the second alloy to form a firm bonding with the substrate to form a composite ingot (6) while it continues to travel through the casting channel.

It has been found that in the embodiment of FIG. 1 it is possible that the temperature difference between the substrate (1) and the top of the molten metal in the casting channel can create stratification of the molten metal (the ordering of relative cold metal at the bottom and relative hot metal at the top) due to thermal buoyancy. As a result, the hot metal entering the casting channel will not necessarily impinge on the substrate and the contact between hot metal and the substrate does not sufficiently occur. As a result, the clad layer of the second alloy will solidify onto the substrate while the substrate does not become hot enough and bonding does not occur or at least not to a sufficient extent. This is overcome in the preferred embodiment of FIG. 2B, shown for clarity alongside FIG. 2A which shows the casting mould used in FIG. 1. As shown in FIG. 2B the upstream entry portion (8) has a narrower cross section of lower height (h1) than the downstream exit portion (9) height (h2). The height ratio (h1 to h2) of the upstream entry portion (8) to the downstream exit portion (9) should be 1 to about 2 or more, for example 1 to about 3 or 1 to about 4, whereas in the embodiment of FIG. 2A the height ratio (h1 to h2) is about equal.

In the method and casting apparatus according to this invention, which is in particular suitable to apply a relatively thick layer of a second alloy on a substrate of a first alloy, typically the height h2 is at least 10 mm, and is preferably in a range of 10 to about 100 mm. And a more preferred lower limit is about 20 mm, and a more preferred upper limit is about 80 mm.

The velocity of the molten metal in the upstream portion of height h1 is expected to be in a range of about 500 to 900 mm/min, which would result in a substantially laminar flow of molten metal.

More preferably the reduced cross sectional height (h1) is combined with a relative narrow channel or gap at part of the upstream entry portion (8). In the embodiment of FIG. 2B the inflow of molten metal is forced to flow at a relatively high speed along the substrate of the first alloy before it enters into the casting channel and a relatively high speed through upstream entry portion (8). Because the height (h1) at the upstream entry portion (8) is less than the height (h2) at the downstream exit portion (9), the molten metal flows at a higher speed at the upstream entry portion (8) than it exits from the downstream exit portion (9). In other words, in the FIG. 2B embodiment, the molten metal is flowing in the horizontal direction (such as direction "A" of FIG. 1) at the upstream entry portion (8) at a higher speed than the substrate (1) at the upstream entry portion (8). In contrast, the substrate (1) has a constant speed at both the upstream entry portion (8) and the downstream exit portion (9); and the substrate (1) and solidified clad layer (2) have the same speed at the downstream exit portion (9). The more intense flow towards and along the surface of the substrate assures improved local heating of the surface and remelting of a relative thin surface layer, which then enables improved bonding between the substrate and the solidifying molten metal while it continues to travel through the casting channel to form the composite ingot.

Moreover, if desired, the outlet (5) may be sized to provide an area through which the velocity of molten metal is within plus or minus 25% of the velocity of the molten metal through h1.

FIG. 3A to 3C shows schematic views of composite ingots having at least two separate formed layers of different alloys. With the method according to the invention it is possible to obtain in the rolling direction of the composite ingot different edge shapes of the layer formed by the second alloy. With the method according to the invention it is possible to tailor the shape in dependence of the plastic flow behaviour during rolling and thereby controlling or limiting the amount of overflow and consequently the need of edge trimming. In this way it is possible to limit the amount of scrap obtained in rolling operations when producing thin gauged sheet products.

FIG. 4 shows a schematic view of a composite ingot having at least two separate formed layers of different alloys, and whereby the solid substrate is formed by a substrate which has been shaped and whereby the second alloy layer is cast onto the shaped surface of the substrate using the method according to this invention. Alternative shapes are possible.

Having now fully described the invention, it will be apparent to one of ordinary skill in the art that many changes and modifications can be made without departing from the spirit or scope of the invention as herein described.

The invention claimed is:

1. A method for casting a composite metal ingot comprising at least two separately formed layers of one or more alloys, the method comprises (a) providing a solid substrate of a first alloy and a molten melt of a second alloy, the solid substrate being positioned such that an upper surface of the substrate is formed by a long side of the solid substrate;

(b) providing a casting mould, the substrate and the casting mould being movable relative to one another, and wherein the casting mould comprises a liquid feed end for supplying the casting mould with a molten second alloy and an exit end with at least one outlet for casting the molten second alloy downwardly onto the substrate, and (c) while continuously moving the casting mould and the substrate relative to one another in a substantially horizontal direction, casting the molten second alloy downwardly through the at least one outlet of the casting mould onto the upper surface of the substrate at a temperature wherein the substrate locally at least partly remelts beginning at a reference point of a remelting zone and mixes at least partly with the molten second alloy to form an alloy pool, and after the remelting the molten alloy pool continuously cools and solidifies at a location away from the reference point and joins the substrate to form the composite ingot before discharging from the casting mould.

2. A method according to claim 1, wherein the composite ingot comprises an aluminium alloy substrate having a thickness of at least 40 mm and the layer of the second alloy has a thickness in a range of 2% to 30% of the thickness of the substrate.

3. A method according to claim 1, wherein the substrate of the first alloy consists of an aluminium alloy having been homogenised prior to casting the molten second alloy onto the substrate.

4. A method according to claim 1, wherein the substrate of the first alloy has been milled prior to casting the molten second alloy onto the substrate.

5. A method according to claim 1, wherein the substrate of the first alloy is formed by an upper rolling face of a rolled plate product.

6. A method according claim 1, wherein the substrate is preheated to a temperature in a range of 0.5 to 0.95 of its melting temperature in degrees Celsius.

7. A method according to claim 6, wherein the substrate is preheated by a burner, an electron beam, electrical resistance, or a high frequency induction coil.

8. A method according to claim 1, wherein the first alloy and the second alloy are aluminium alloys having different compositions.

9. A method according to claim 1, wherein the molten second alloy is fed from above the substrate onto an upper surface of the substrate while the substrate is horizontal.

10. A method according to claim 1, wherein the casting mould is planar.

11. A method according to claim 1, wherein the casting mould in part or in whole is made of a refractory ceramic, metal, graphite, or metal coated with a refractory substance.

12. A method according to claim 1, wherein the casting mould comprises a liquid feed end, an exit end with at least one outlet, and a casting chamber to receive molten metal of the second alloy from the outlet, said casting chamber being formed by a casting channel extending from an upstream entry portion and a downstream exit portion for facing a substantially horizontally positioned movable substrate for containing and shaping the molten metal into a layer joined with the moving substrate to form a composite ingot.

13. A method according to claim 12, wherein the upstream entry portion and the downstream exit portion have substantially the same cross-sectional area.

14. A method according to claim 12, wherein the upstream entry portion and the downstream exit portion each have a height (h1,h2) relative to the distance of the movable substrate, and wherein the height (h2) of the downstream exit portion is at least twice the height (h1) of the upstream entry portion.

15. A method according to claim 14, wherein the height (h2) of the downstream exit portion is at least 10 mm.

16. A method according to claim 14, wherein the height (h2) of the downstream exit portion is at least 20 mm.

17. A method according to claim 1, wherein the casting mould near the downstream exit portion is provided with cooling means to remove heat from the solidified layer of the second alloy of the composite ingot.

18. A method according to claim 1, wherein the molten second alloy is fed from above the substrate onto an upper surface of the substrate while the substrate is horizontal and the casting mould does not rotate.

19. A method according to claim 1, wherein the casting mould is planar and does not rotate.

20. A casting device for carrying out a method for casting a composite metal ingot comprising at least two separately formed layers of one or more alloys, comprising:

a casting mould, and means for moving the substrate of the first alloy relative to the casting mould, and means for replenishing a feed end of the casting mould with molten feedstock of second alloy; and the casting mould comprising: the feed end for supplying the casting mould with the molten second alloy, and an exit end with at least one outlet for casting the molten second alloy downwardly onto the substrate, and then into a casting channel of a casting chamber defined by the casting mould over the substrate, while continuously moving the substrate relative to the casting mould, the exit end being for casting the second molten alloy onto the substrate at a temperature at which the substrate locally at least partly remelts beginning at a reference point of a remelting zone and mixes at least partly with the molten second alloy to form an alloy pool, and said means for moving comprising means for moving the molten alloy pool as the pool continuously cools and solidifies after the remelting, at a location away from the reference point and joins the substrate to form the composite ingot before discharging from the casting mould.

* * * * *